US005732942A

United States Patent [19]

Crameri et al.

[11] Patent Number: 5,732,942

[45] Date of Patent: Mar. 31, 1998

[54] DEVICE FOR DELIVERING AND/OR STACKING SHEET-LIKE PRINTING MEDIA

[75] Inventors: Roberto Crameri, Zürich; Thomas Rutishauser, Uerikon, both of Switzerland

[73] Assignee: Rutishauser Data AG, Stafa, Switzerland

[21] Appl. No.: 586,622

[22] Filed: Feb. 28, 1996

[30] Foreign Application Priority Data

Mar. 1, 1995 [CH] Switzerland ..... 00573/95

[51] Int. Cl.[6] ..... B65H 43/00

[52] U.S. Cl. ..... 271/176; 271/81

[58] Field of Search ..... 271/81, 200, 176, 271/199, 201, 3.09

[56] References Cited

U.S. PATENT DOCUMENTS

| | | | |
|---|---|---|---|
| 3,536,318 | 10/1970 | Gay et al. . | |
| 3,682,473 | 8/1972 | Kuyt | 271/201 |
| 4,274,623 | 6/1981 | Reist et al. . | |
| 4,322,069 | 3/1982 | Mitchell | 271/200 |
| 4,354,674 | 10/1982 | Dorer et al. . | |
| 4,822,025 | 4/1989 | Chung . | |
| 4,881,730 | 11/1989 | Kaneko . | |
| 4,890,826 | 1/1990 | Rutishauser . | |
| 4,958,827 | 9/1990 | Kaneko | 271/201 |
| 5,439,207 | 8/1995 | Rünzi | 271/201 |
| 5,524,877 | 6/1996 | Weber et al. | 271/220 |

FOREIGN PATENT DOCUMENTS

| | | |
|---|---|---|
| 0023169 | 1/1981 | European Pat. Off. . |
| 0020900 | 7/1981 | European Pat. Off. . |
| 0231961 | 12/1987 | European Pat. Off. . |
| 1036811 | 8/1958 | Netherlands . |
| 1110775 | 4/1968 | United Kingdom . |
| 1 515 440 | 6/1978 | United Kingdom . |
| 2139195 | 11/1984 | United Kingdom . |

*Primary Examiner*—W. Grant Skaggs
*Attorney, Agent, or Firm*—Adams Law Firm, P.A.

[57] ABSTRACT

A delivery device conveys the sheets which are output by a laser printer for delivery onto a pile. For adaptation to the growing height of the pile, at least one conveying roll defining an output is arranged on a height-adjustable carriage. A sensor lever scans the respective height of the pile and brings about automatic tracking of the carriage. The carriage is mounted so as to be longitudinally displaceable on a drive shaft by means of at least one guide. The carriage can be moved vertically along the drive shaft by driving wheels which press against the drive shaft. By means of this device, the achievable stacking height can be multiplied relative to the standard height.

9 Claims, 3 Drawing Sheets

DEVICE FOR DELIVERING AND/OR STACKING SHEET-LIKE PRINTING MEDIA

TECHNICAL FIELD AND BACKGROUND OF THE INVENTION

The invention relates to a device for delivering and/or stacking sheet-like printing media.

Such a device built onto a printer receives the individual printing media, usually printed sheets, conveyed out of an output opening of the printer in order to convey them further and form a pile therefrom.

The designation printers comprises all the apparatuses which produce printed products in the form of single sheets, for example the printers which are customary in conjunction with PC's, copiers, fax machines and, if appropriate, also offset printing machines. However, the invention is particularly suitable for high-speed laser printers and copiers as well as for combined printers, such as for example a printer/copier/fax machine.

The printers which are customary in offices are usually provided for an output of up to 200 sheets. This generally corresponds to the receiving capacity of a single supply magazine. If, however, a printer is fitted with or connected to a plurality of or larger supply magazines, the output in one operation can be a multiple of the intended receiving capacity of the delivery surface of the printer. To receive such a quantity, a stacking region is necessary which is dimensioned to be correspondingly high. However, this requires a relative movement between the base of the pile and the sheet-feeding plane in order to guarantee a satisfactory delivery of the sheets on the pile with an increasing pile height. Without such a relative movement, an excessively large drop height would result at the beginning of the pile formation and prevent satisfactory pile formation, in particular when the sheets leave the printer in a curved manner.

For this purpose, it is known to move a table serving as a stacking surface downwards with an increasing pile height with a sheet-feeding plane remaining at the same height. In another known device, the pile is raised for each sheet supplied in order to push the sheet below it in each case. In both cases, it is necessary to move the relatively heavy pile by means of a drivable device, for which purpose a heavy construction and a corresponding energy consumption are required. Although resilient pile deliverers are also known, which move downwards under an increasing weight, these are inaccurate in maintaining an optimum height for delivery.

SUMMARY OF THE INVENTION

Therefore, it is an object of the invention to provide a to provide a device of the type mentioned at the beginning, with which a relatively large pile height can be achieved without moving the pile by means of a drive device.

The solution according to the invention is particularly suitable for a stacking base which is not connected to a drive device, for example for the delivery surface which is already present in a printer or even for another type of stationary delivery surface. Considerably greater pile heights can be achieved, for example of two thousand sheets and above, by means of the automatic adaptation of the sheet-feeding plane to the upper end of the pile.

The device according to the invention can be designed in a particularly simple manner due to the possibility of utilizing the delivery surface of a printer, which is already available, as a stacking base for the far greater pile height.

Furthermore, space is saved in such a solution since no additional standing area is required for the device according to the invention if the latter is placed on top of a printer and, if appropriate, is attached thereto.

A further advantage is the omission of a lifting device dimensioned for the heavy pile, which has the effect of saving material, space and energy. Furthermore, the solution according to the invention has the advantage that a height adjustment of the carriage is made possible with particularly simple means.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
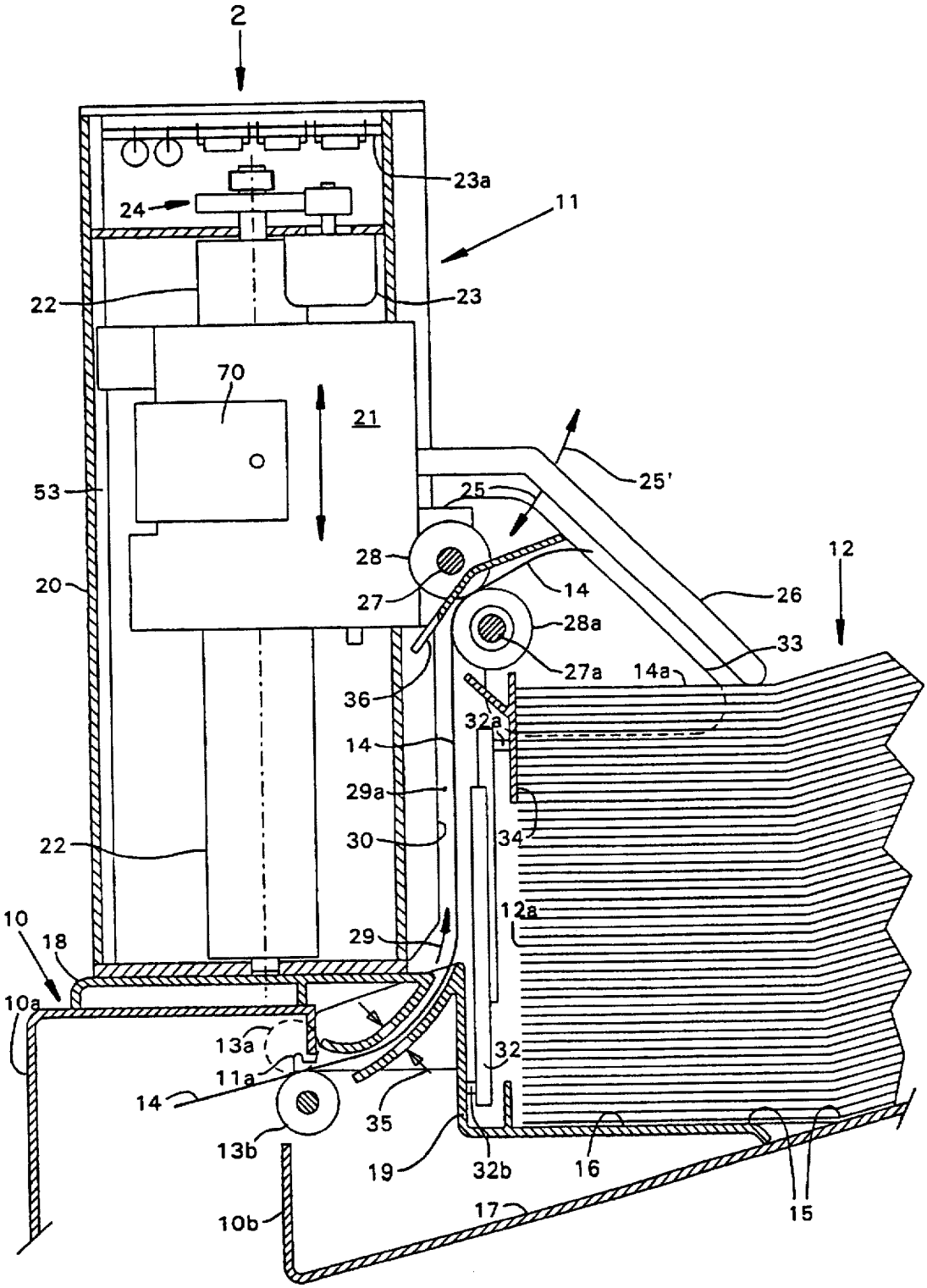
FIG. 1 shows a device placed on top of a laser printer for stacking printed sheets, having a carriage which adjusts in the vertical direction, partly in a longitudinal section viewed from the side.

Referring now specifically to the drawings, FIG. 1 shows a stacking device 11 which is placed on top of a laser printer 10 and is secured thereon by means of a hook element 11*a*. It serves to form a pile 12 whose height can many times exceed the height usually known as the maximum height of, for example, 200 sheets.

The laser printer 10 has parts 10*a*, 10*b*, illustrated in section, of an upper covering and at least one conveying roll 13*a*, 13*b* by means of which a printed sheet 14 is respectively conveyed out, which is received by the stacking device 11 and delivered to the stacked sheets 14*a* on the pile 12.

The pile 12 rests on a stationary stacking base 15 which is formed for one part by a surface 16 of the stacking device 11 and for the other part by a delivery surface 17 of the laser printer 10. The stacking base 15, however, can also be formed completely either by a part of the stacking device 11 or by a part of the laser printer 10. In the present exemplary embodiment, the delivery surface 17 of the laser printer 10 is the standard delivery surface when there is no stacking device.

The stacking device 11 has profiled plinth parts 18, 19 which are illustrated in section and are adapted to the laser printer 10. Built up thereon is a likewise profiled shaft element 20 which is illustrated in section and in which a carriage 21 is guided in the manner of a lift. Serving as a drive for the carriage 21 is an upright drive shaft 22 which can be driven continuously via a mechanism 24 by an electric motor 23, for example a DC motor with a clock generator. A circuit arrangement 23*a* on a circuit board serves to control the motor 23. The connection of the drive shaft 22 to the carriage 21 is explained with reference to the following Figures.

A smooth-running sensor lever 26, with which the respective height of the pile 12 is scanned, is mounted so as to be pivotable in the direction of the double arrow 25, 25' on a control element 41 (cf. FIGS. 2 and 3) in the carriage 21. When the height increases, the carriage 21 moves upwards to an approximately equal extent. When the pile is removed, the carriage 21 moves downwards.

Furthermore, two horizontal shafts 27, 27*a* are arranged on the carriage 21, of which shafts the shaft 27 is connected in terms of drive to the drive shaft 22 via drive elements which are not visible in FIG. 1. Spaced-apart conveying rolls 28 are arranged securely in terms of rotation on the shaft 27. Arranged securely in terms of rotation on the shaft 27*a* are nipping rolls 28*a* between which and the conveying rolls 28 a clamping gap is formed. In this clamping gap, the sheet 14 which is delivered by the conveying roll(s) 13*a*, 13*b* of the laser printer 10 and is deflected upwards into the conveying route 29 is conveyed onto the pile 12. The conveying route 29 is defined by a conveying channel 29*a*.

On one broad side, the conveying channel 29*a* is bounded by the surface 30 of the shaft element 20 facing the pile 12 and, on the other broad side, by at least one guide element 32 which can be pushed together in the manner of a telescope. The upper end of the guide element 32 is attached by a pintle 32*a* to a Y-shaped support plate 34 which is arranged fixedly on the carriage 21 between two lateral guiding elements 33.

The lower end of the guide element 32 is rotatably connected to the plinth part 19 by means of a pintle 32*b*. The two pintles 32*a* and 32*b* are arranged offset relative to one another in the axial direction of the drive shaft 22. When the carriage 21 moves upwards or downwards, the guide element 32 attached rotatably to its two ends is pulled apart or pushed together in order to reliably delimit the conveying channel 29*a* in any position of the carriage 21. The individual telescope elements of the guide element 32 (not illustrated here) are designed such that the Y-shaped support plate 34 can be brought into contact with the plinth part 19 during the downward movement of the carriage 21.

The lateral guiding elements 33 which are likewise arranged on the carriage 21 on both sides of the pile 12 serve for the lateral guiding of the sheet to be delivered respectively onto the pile 12. These guiding elements 33 which run along with the carriage 21 guarantee a satisfactory pile formation by means of a lateral guiding of the sheets supplied at the upper end of the pile. The lower part of the pile 12 requires no lateral guiding since it has sufficient inherent stability due to its own weight.

The sensor lever 26 constantly resting on the pile 12 is light so that it does not impede the supply of sheets.

A stop (not illustrated) which can be attached adjustably to the sensor lever 26 can be provided at the outer end face of the pile 12 remote from the stacking device 11. The support plate 34, together with the guide element 32 attached rotatably thereto at the inner end face 12*a* of the pile 12 facing the stacking device 11 serves as an end-face stop for the upper end of the pile 12.

The arrows 35 at the input into the conveying channel 29*a* denote a light barrier whose beam is interrupted by the sheet 14 supplied by the printer 10. The stacking device 11 is thus caused to start by switching on the drive 23, 24 for the drive shaft 22. After a specific time, after no further sheet has been supplied, the drive is switched off again. An automatic, energy-saving operation of the stacking device 11 is thus guaranteed. Additionally, the unavoidable development of noise is restricted to a minimum.

A deflection element 36 which is attached to the carriage 21 by means which are not illustrated is located in front of the output of the conveying channel 29*a* in order to ensure that the sheet 14 conveyed up through the conveying channel 29*a* is guided by the conveying rolls 28 into an output 37 which is disposed at least approximately horizontally in order to guarantee a reliably delivery on the pile 12, the sheet 14 having to overcome the nipping rolls 28*a*. For secure further conveying, the latter can be fitted, if appropriate, on the circumferential side with nub-like elevations (not illustrated).

The deflection element 36 attached to the carriage 21 bears at each of its two outer ends one of the two lateral guiding elements 33. The shaft 27*a* is mounted in the said guiding elements (cf. FIG. 2).

Figure 2:
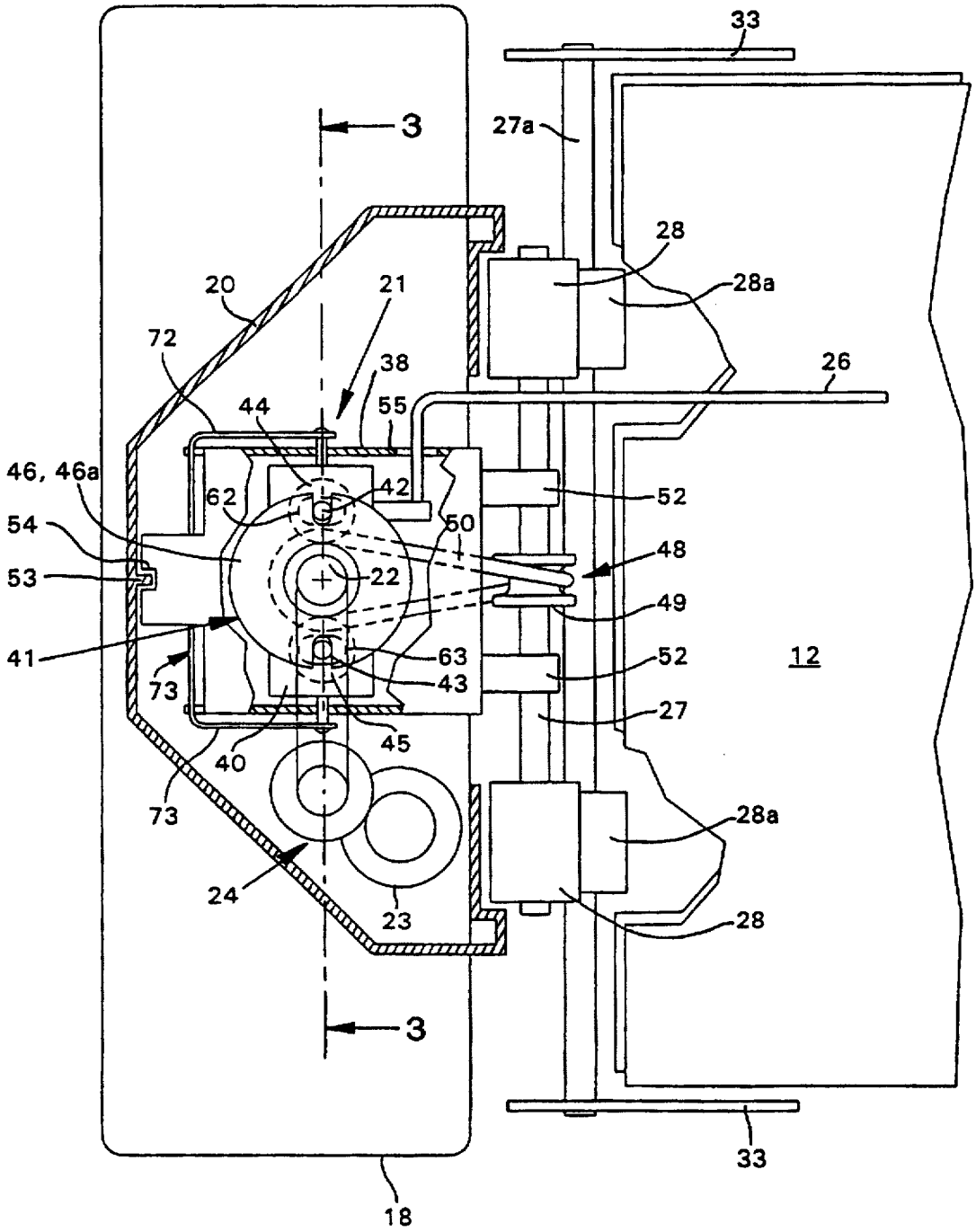
FIG. 2 shows a plan view in the direction of the arrow A of the device according to FIG. 1, partly in cross-section.

Most of the elements already explained in relation to FIG. 1 can be recognized in FIG. 2 by way of the same reference numerals. Furthermore, it can also be seen that the drive shaft 22 extends through the carriage 21. The carriage 21 has a housing 38 which is rectangular in cross-section, but can also have a different suitable shape. Provided inside the housing 38 is a control element 41 comprising two guide elements designed as bushings 39 and 40 (only bushing 40 visible here). As will be explained more clearly in conjunction with the following FIG. 3, a driving wheel 44, 45 attached to an axle 42, 43 is respectively provided, which driving wheels are held firmly in the associated bushings 40 and 39, for example by being pressed in. The axles 42 and 43 are connected to one another in an articulated manner in their end regions by two annular discs 46, 46*a* by means of their recesses which are open on one side—only the upper annular disc 46 is visible in FIG. 2.

The shaft 27 is connected to the drive shaft 22 so that it can be driven in rotation by means of a belt mechanism 48 crossed at right angles. The belt mechanism 48 has a fluted roller 49 which is firmly connected to the shaft 27 and a belt 50 which is wrapped around the drive shaft 22. During the upward or downward movement of the carriage 21, the belt 50 also travels with its inner friction surface along the drive shaft 22. This particularly simple and practical mode of driving the shaft 27 by means of the crossed belt mechanism 48 allows the wrapping of the belt 50 around the drive shaft 22 to be adapted automatically to the respective adjusted height of the carriage 21. Optimum tension of the belt 50 is thus always guaranteed.

As can furthermore be seen each conveying roll 28 is assigned a nipping roll 28*a*. Furthermore, the shaft 27 is mounted in two brackets 52 arranged on the housing 38, and the shaft 27*a* is mounted in the two guiding elements 33 as mentioned above. Since the guiding elements 33 are firmly connected to the carriage 21 via the support plate 34*a* (cf. FIG. 1), a predetermined distance between the shafts 27 and 27*a* and thus also the clamping gap between the conveying rolls 28 and the nipping rolls 28*a* is guaranteed. It can thus be seen that the parts specified above are also moved during a lifting movement of the carriage 21 which has yet to be described.

Located on the back of the shaft element 20 is a vertical web 53 which is directed inwardly and engages in a groove 54, arranged on the housing 38 of the carriage 21, as a securement against rotation for the carriage 21, but leaves the latter sufficient clearance for the lifting movement.

The sensor lever 26 is passed through a slot 55 in the housing 38 and is attached by its end to the axle 42. The axle 42 can thus be pivoted with the driving wheel 44. By means of the articulated connection of the axles 42 and 43 via the two annular discs 46, 46*a*, the axle 43 is thus pivoted with the driving wheel 45 by the sensor lever 26 in opposition to the drive shaft 22.

Figure 3:
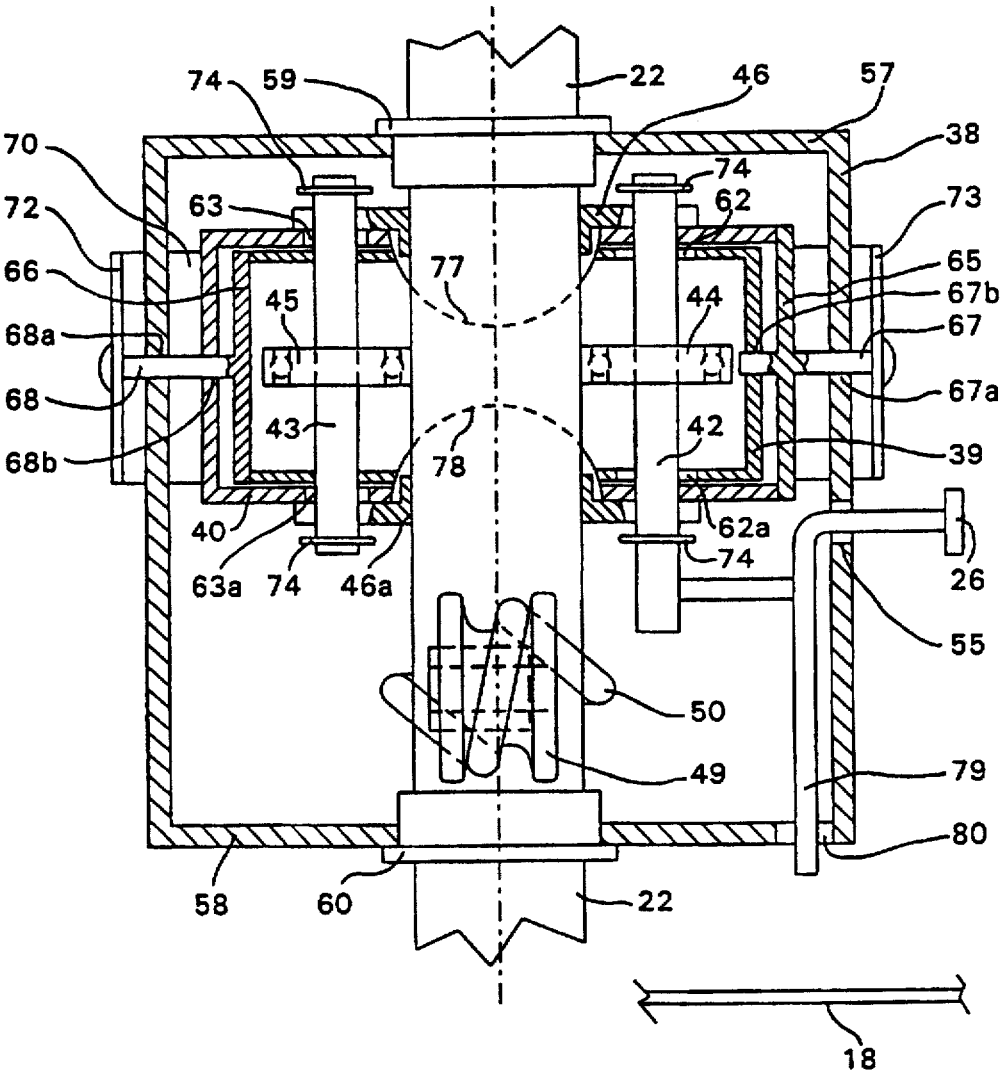
FIG. 3 shows a cross-section through the carriage with a partial plan view of the driving wheels arranged therein along the line B—B in FIG. 2.

The precise construction of the height-adjustment mechanism can be seen in FIG. 3. Housing 38 is provided on the top side 57 with a guide element designed as a ring 59 and, on the underside 58, with a guide element designed as a ring 60 for the drive shaft 22. The bushing 39 bearing the driving wheel 45 is mounted rotatably inside the bushing 40 which bears the driving wheel 44. Longitudinal slots 62 and 62*a* of identical design are provided in the bushing 39 in the region of the right-hand axle 42 and identical longitudinal slots 63 and 63*a* are provided in the bushing 40 in the region of the left-hand axle 43 (cf. also FIG. 2). The length of these identical longitudinal slots 62, 62*a* and 63, 63*a* limits the rotation of the axles 42 and 43. Furthermore, the longitudinal slots 62, 62*a* and 63, 63*a* are slightly wider than the diameter of the axles 43 and 42, i.e. the latter have a certain clearance so that the driving wheels 45 and 44 can be pressed with the required contact pressure against the drive shaft 22.

The driving wheels 44 and 45 consequently lie in the neutral position in approximately the same plane, and their axles 42 and 43 are then parallel to the drive shaft 22 so that the carriage 21 remains at the same height. When the axles 42 and 43 are pivoted by the oppositely rotating bushings 39 and 40, the driving wheels 44 and 45 roll with frictional engagement along the drive shaft 22 in a helical line so that the carriage 21 is moved upwards or downwards.

The bushing 40 is terminated at the end face by a round cover 65 and the bushing 39 by a round cover 66. Attached to the cover 65 is a pin 67 which, on the one hand, passes through the housing 28 through a bore 67*a* and, on the other hand, engages in a central bore 67*b* in the bushing 39. Attached to the cover 66 is a pin 68 which, on the one hand, passes through a bore 68*a* in the housing 38 and through a central bore 68*b* in the bushing 40. By means of the pins 67 and 68, a U-shaped spring element or clamping bow 70 made of spring bronze is tensioned, which presses with its limbs 72 and 73 against the pins 67 and 68 and thus presses the driving wheels 44 and 45 firmly against the drive shaft 22 (cf. also FIG. 2).

In order to keep the friction losses as low as possible, the driving wheels 44 and 45 are advantageously designed as ball bearings. By means of the design of the control element 41 with the bushings 39 and 40 rotating in opposition to one another in a smoothly running manner, a very good force transmission of the clamping bow 70 to the driving wheels 44 and 45 is possible, virtually without friction losses. The actual height-adjustment mechanism, which has the bow holder 70 with the driving wheels 44 and 45, is consequently independent of the guiding of the carriage 21 which is carried out by the rings 59 and 60 and by the groove 54 interacting with the web 53. By means of the clamping bow 70, a sufficient pressing force can be exerted on the ball bearings 44 and 45 so that an excellent, frictionally engaged drive connection with the drive shaft 22 is achieved.

Furthermore, it can be seen in FIG. 3 that the bushings 39 and 40 are provided with saddle-shaped oval cutouts 77 and 78, so that the drive shaft 22 can be passed through the two bushings 39 and 40 rotating in opposition to one another. The annular discs 46 and 46*a* described are partly recessed into these saddle-shaped cutouts 77 and 78 and are secured axially on the axles 42 and 43 by means of securing rings 74.

Furthermore, the sensor lever 26 is provided with a stop 79 which passes through a slot-shaped opening 80 in the housing 38. When the pile 12 has been removed completely, the carriage 21 moves right down to the bottom, due to the position of the sensor lever 26 and thus of the driving wheel 44 and 45, until the stop 79 rests on the plinth part 18. The latter moves the sensor lever 26 back into the neutral position so that the driving wheels 44 and 45 are likewise moved into the neutral position, in which case they are disposed precisely at right angles to the drive shaft 22.

The above-mentioned design of the height-adjustment mechanism is of technically advantageous design and is also constructed to be particularly simple and cost-effective in terms of manufacture. Since the forces exerted on the driving wheel 44 and 45 are absorbed solely by the spring element designed as a U-shaped bow 70, no further torques occur on the carriage 21, for which reason the friction losses are lower during its upward or downward movement.

As was briefly explained previously, the mode of action of the height-adjustment mechanism according to the invention is particularly simple: owing to the sensor lever 26, the pile height of the pile of printing media 14*a* delivered on the stacking base 15 is scanned, and the carriage 21 is correspondingly moved upwards or downwards by the driving wheels or ball bearings 44 and 45. When the correct height for the output 37 has been reached, the ball bearings 44 and 45 are disposed precisely at right angles to the drive shaft 22, i.e. the axles 42 and 43 are then aligned precisely parallel to the drive shaft 22.

As emerges from the above embodiments, the device according to the invention is advantageous in many respects. It allows the stacking surface of a printer which is already available to be utilized so that it is possible to deliver a multiple of the number of printing media which is otherwise customary, it requires no additional standing area, needs only a single motor for the height-adjustment and the drive of the conveying rolls 28, the transmission of the driving force for the two tasks taking place by means of a single shaft 22, and it achieves the control or automatic regulation of the height-adjustment in a very simple manner solely using mechanical means.

The height-adjustment taking place in dependence on the position of the sensor lever 26 operates entirely continuously, in a manner comparable to a continuous proportional control. The greater the deviation of the pile is from the assigned position of the height-adjustable output 37, for example when the pile 12 is removed, the greater is the pivoting of the sensor lever 26 and the more rapidly the adjustment takes place. As soon as the height-adjustable output 37 approaches its target, the slower the adjustment speed becomes, until the neutral position is achieved as a state of equilibrium.

A further notable feature of the invention is that an adjustment is possible in both directions of adjustment with the direction of rotation of the driving shaft 22 remaining the same, and that the reversal takes place in a gentle manner.

For the pile formation, it is sufficient to guide the pile 12 at its upper edge, the guide elements 32, 34 serving this purpose and the adjustable stop (not illustrated) which may be provided at the outer end face of the pile 12 running along with the carriage 21.

It is obvious to the person skilled in the art that not only a U-shaped bow 70 can be used as spring element, but also a pincer-like tensioning element whose tensioning jaws are tensioned relative to one another by a tension spring between the opposite end regions. This tensioning element can additionally be designed in such a way that the tension spring is arranged so as to be adjustable, for example, at the attachment points, so that it is possible to adjust the tensioning force to be exerted on the driving wheels 44 and 45.

A device for delivering and/or stacking sheet-like printing media is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A device for delivering and/or stacking sheet-like printing media for a printer intended for printing, copying or for fax transmission, comprising:

a conveying route arranged at an output of the printer for conveying the printing media onto a deliverer, the conveying route including conveying means and an outlet for the printing media arranged so as to be height adjustable relative to a stacking base of the deliverer;

a vertically moveable carriage supported on a drive shaft and carrying the height-adjustable outlet for displacement thereof along the length of the drive shaft, said carriage including driving wheels frictionally engaging the drive shaft and rolling along the drive shaft in a helical path for moving the carriage in an upwardly and downwardly direction; and wherein the driving wheels lie in approximately the same plane when in a neutral position.

2. A device according to claim 1, wherein the driving wheels are adjustable and have respective axles which are essentially parallel to the drive shaft.

3. A device according to claim 2 wherein the driving wheels are mounted on respective axles which are pivotable in opposition to the drive shaft by means of a sensor which scans the height of the pile of printing media.

4. A device according to claim 3, wherein the axles of the driving wheels are connected to one another in an articulated manner and are arranged so as to be pivotable in a control element which surrounds the drive shaft.

5. A device according to claim 4, wherein the control element comprises two guide parts which each bear an axle of a driving wheel and which are clamped so as to be rotatable in opposite direction and by means of a spring element which presses the driving wheels against the drive shaft independently of the carriage.

6. A device according to claim 5, wherein the guide parts comprise bushings which are slid one inside the other, the bushings are mounted on opposite sides to one another, and each bushing has a pin which passes through the carriage on the end face facing the inner wall of the carriage.

7. A device according to claim 6, wherein the spring element is a U-shaped bow which engages around the carriage and whose limbs press against the pins of the bushings.

8. A device according to claim 1, 2, 3, 4, 5, 6, or 7, wherein the carriage has a housing with a upper and a lower closure element, each of which upper and lower closure elements including a guide ring surrounding the drive shaft.

9. A device according to claim 8, wherein the conveying means include at least one conveying roll which is height-adjustable together with the carriage and is driven by a crossed belt mechanism of the drive shaft.

* * * * *